US006699099B1

(12) United States Patent
Ledford

(10) Patent No.: US 6,699,099 B1
(45) Date of Patent: Mar. 2, 2004

(54) NOVELTY ARTICLE HAVING AN ELONGATED MEMBER ROLLABLE UPON ITSELF AND RELEASABLE FROM ITSELF WITH A DRAG-GENERATING CONTROLLED UNROLLING ACTION

(76) Inventor: Kevin D. Ledford, P.O. Box 889, Grove, NC (US) 28073

( * ) Notice: Subject to any disclaimer, the term of this patent is extended or adjusted under 35 U.S.C. 154(b) by 0 days.

(21) Appl. No.: 10/315,462

(22) Filed: Dec. 10, 2002

(51) Int. Cl.[7] ..... A63H 3/36
(52) U.S. Cl. ..... 446/320; 446/486; 446/369
(58) Field of Search ..... 446/369, 370–372, 446/268, 308, 309, 310, 311, 320, 486, 901, 71–72, 76; 40/411

(56) References Cited

U.S. PATENT DOCUMENTS

| | | | | |
|---|---|---|---|---|
| 62,648 A | | 3/1867 | Levine | |
| 1,355,799 A | * | 10/1920 | Bradish | |
| 1,559,165 A | | 10/1925 | Hammond | |
| 1,903,082 A | * | 3/1933 | Adams | |
| 2,598,807 A | * | 6/1952 | Lawson, Jr. et al. | |
| 2,824,409 A | | 2/1958 | Brodrib | 46/129 |
| 2,851,270 A | | 9/1958 | Ball | 272/27 |
| 3,360,261 A | | 12/1967 | Smolensky | 272/67 |
| 3,410,023 A | | 11/1968 | Anello | 46/123 |
| 3,448,539 A | * | 6/1969 | Hartpence | |
| 4,024,657 A | * | 5/1977 | Dutcher | 40/126 R |
| 4,087,989 A | | 5/1978 | Taran | 63/11 |
| 4,724,548 A | | 2/1988 | London | 2/338 |
| 4,778,433 A | | 10/1988 | McKay et al. | 446/304 |
| 5,176,452 A | | 1/1993 | Stern | 383/43 |
| 5,194,033 A | * | 3/1993 | Wright | 446/311 |
| 5,391,106 A | | 2/1995 | Lidert, Jr. | 446/337 |
| 6,361,395 B1 | * | 3/2002 | Pacza | 446/368 |

* cited by examiner

*Primary Examiner*—Jacob K. Ackun
*Assistant Examiner*—Joel Williams
(74) *Attorney, Agent, or Firm*—Flanagan & Flanagan; John R. Flanagan

(57) ABSTRACT

A novelty article includes a base member, an elongated member mounted thereto and made of resiliently flexible material tending to assume an unrolled extended condition when unrestrained by an outside force and being manually rollable upon itself so as to bring opposite portions into contact with one another as the elongated member is rolled upon itself to a rolled-up compact condition, and elements on the elongated member for detachably attaching together the opposite portions thereof when brought into contact with one another such that upon release of the elongated member from the rolled-up compact condition these elements will detach from one another and concurrently generate a drag effect on the detaching of the opposite portions of the elongated member which limits the elongated member to undergoing a controlled progressive unrolling action from the rolled-up compact condition to the unrolled extended condition.

20 Claims, 4 Drawing Sheets

NOVELTY ARTICLE HAVING AN ELONGATED MEMBER ROLLABLE UPON ITSELF AND RELEASABLE FROM ITSELF WITH A DRAG-GENERATING CONTROLLED UNROLLING ACTION

BACKGROUND OF THE INVENTION

1. Field of the Invention

The present invention generally relates to a novelty articles, such as toys and the like, and, more particularly, is concerned with a novelty article having an elongated member being rollable upon itself into a rolled-up compact condition and releasable from itself with a drag-generating controlled progressive unrolling action into an unrolled extended condition.

2. Description of the Prior Art

A large portion of human endeavors are devoted to entertaining other humans, especially children. This is evident from the enormous efforts expended by the toy industry to produce novelty devices that provide fun for children.

Many novelty devices have active parts that move up and down, uncoil and recoil, or extend and retract for achieving various design purposes and also to attract and hold the attention of children. Examples of these devices are the ones disclosed in U.S. Pat. No. 2,824,409 to Brodrib, U.S. Pat. No. 2,851,270 to Ball, U.S. Pat. No. 3,360,261 to Smolensky, U.S. Pat. No. 3,410,023 to Anello, U.S. Pat. No. 4,724,548 to London, U.S. Pat. No. 4,778,433 to McKay et al. and U.S. Pat. No. 5,391,106 to Lidert, Jr.

These prior art novelty devices appear to achieve the specific purposes for which they were designed. However, the inventor herein has perceived a need for a novelty article which can be employed as an action component in toys, such as plush animal toys, which heretofore, for the most part, have not utilized such action components.

SUMMARY OF THE INVENTION

The present invention provides a novelty article designed to satisfy the aforementioned need. The novelty article of the present invention has an elongated member being manually rollable upon itself into a rolled-up compact condition and releasable from itself with a drag-generating controlled progressive unrolling action into an unrolled extended condition. The elongated member can provide an action component for any of a wide variety of toys and other novelty items, such as plush animal toys, which may otherwise be passive in nature.

Accordingly, the present invention is directed to a novelty article which comprises: (a) a base member; (b) an elongated member made of resiliently flexible material tending to assume an unrolled extended condition when unrestrained by application of any outside force thereto, the elongated member having a pair of opposite ends and opposite portions extending between the opposite ends, the elongated member being mounted at one of the opposite ends to the base member and being manually rollable upon itself so as to bring the opposite portions thereof into contact with one another as the elongated member is rolled upon itself from the unrolled extended condition in which the opposite ends thereof are spaced remote from one another to a rolled-up compact condition in which the opposite ends thereof are spaced adjacent to one another; (c) means for detachably attaching together the opposite portions of the elongated member when brought into contact with one another as the elongated member is rolled upon itself to the rolled-up compact condition such that upon release of the elongated member from the rolled-up compact condition the detachably attaching means permits the opposite portions of the elongated member to detach from one another and the elongated member to return to the unrolled extending condition as the detachably attaching means concurrently generate a drag effect on the detaching of the opposite portions of the elongated member from one another which limits the elongated member to undergoing a controlled progressive unrolling action that begins at the one end and ends at the opposite end of the elongated member as the elongated member returns to the unrolled extended condition; and (d) a latch member connected to the base member and detachably secured to the elongated member so as to restrain the elongated member in the rolled-up compact condition until the attachment member is pulled away and detached from the elongated member by a user such that the elongated member is released to undergo the controlled progressive unrolling action from the rolled-up compact condition to the unrolled extended condition.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
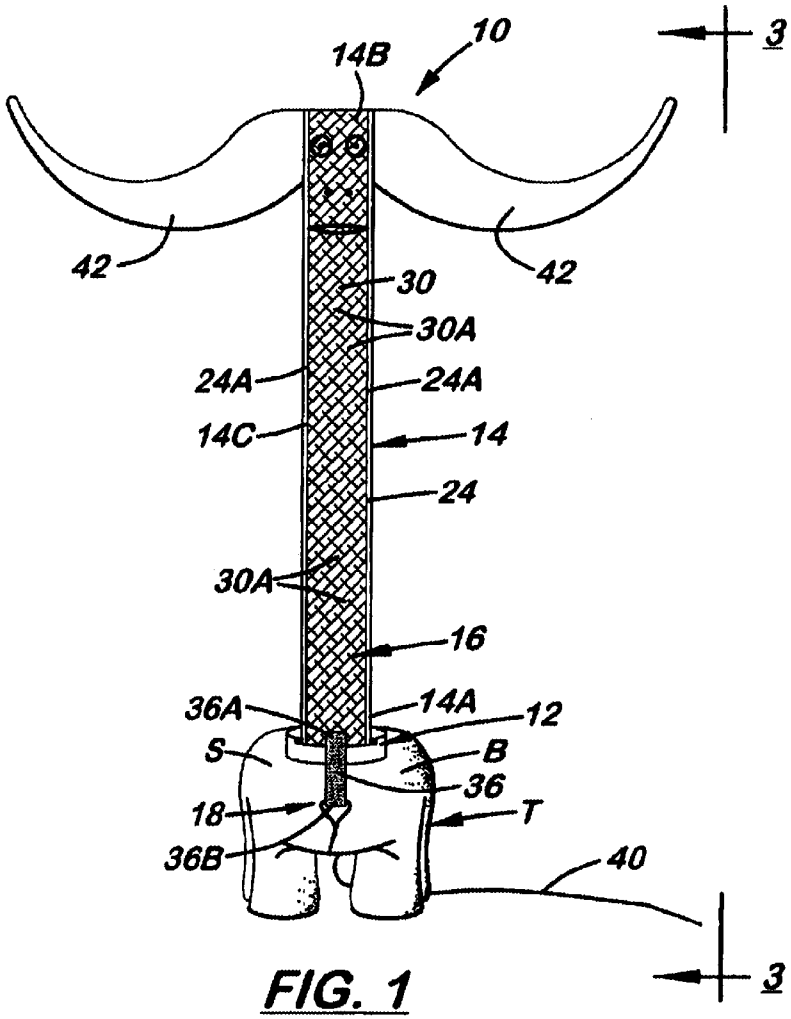
FIG. 1 is a front elevational view of a novelty article of the present invention employed in conjunction with a body of a plush-type toy, the article shown having an elongated member disposed in an unrolled extended condition and a detachably attachable element secured on one longitudinal side of the elongated member.

Referring to the drawings and particularly to FIGS. 1–6, there is illustrated a novelty article of the present invention, generally designated 10. Basically, the novelty article 10 includes a base member 12, an elongated member 14, means 16 for detachably attaching the elongated member 14 to itself, and a latch member 18. By way of an example, the novelty article 10 is shown attached by the base member 12 thereof on front shoulders S of the body B of a stuffed plush-type toy T.

Figure 9:
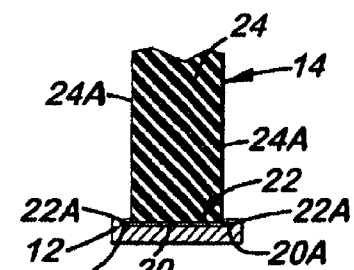
FIG. 9 is an enlarged fragmentary longitudinal sectional view of a tongue and groove type of mateable connector elements between the base member and a lower end of the elongated member of the novelty article taken along line 9—9 of FIG. 7.

The elongated member 14 of the novelty article 10 has opposite lower and upper ends 14A, 14B and a pair of opposite side portions 14C, 14D extending longitudinally or lengthwise of the elongated member 14 between the opposite lower and upper ends 14A, 14B thereof. The elongated member 14 is mounted at its lower end 14A to the base member 12. In one exemplary arrangement shown in FIGS. 3, 4 and 9, the base member 12 and the lower end 14A of the elongated member 14 have respective mateable mounting elements thereon in the form of a rigid plate 20 adhered to the bottom of the lower end 14A and a recess 22 defined in a top of the base member 12. The plate 20 has a pair of opposite side flanges 20A which slidably fit into a pair of grooves 22A defined at the corresponding opposite sides of the recess 22. The side flanges 20A of the plate 20 are insertable and engageable within the respective grooves 22A of the recess 22 or disengageable therefrom for correspondingly mounting the elongated member 14 on the base member 12 or dismounting the elongated member 14 therefrom. If desired, once the plate 20 is inserted into the recess 20 and thereby the elongated member 14 mounted to the base member 12, it can be permanently adhered to the base member 12 by use of a suitable adhesive or the like to affix the flanges 20A in the grooves 22A so that the plate 20 cannot be removed from the recess 22.

Figure 2:
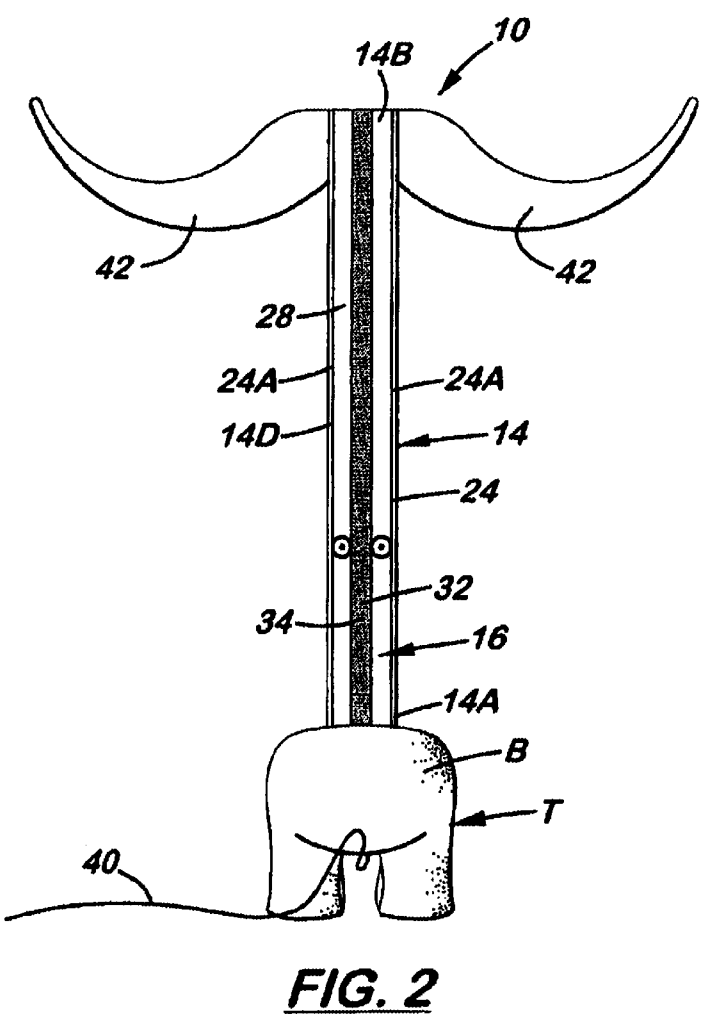
FIG. 2 is a rear elevational view of the novelty article of FIG. 1 also showing the elongated member of the novelty article in the unrolled extended condition and having another detachably attachable element on the opposite longitudinal side of the elongated member.
Figure 4:
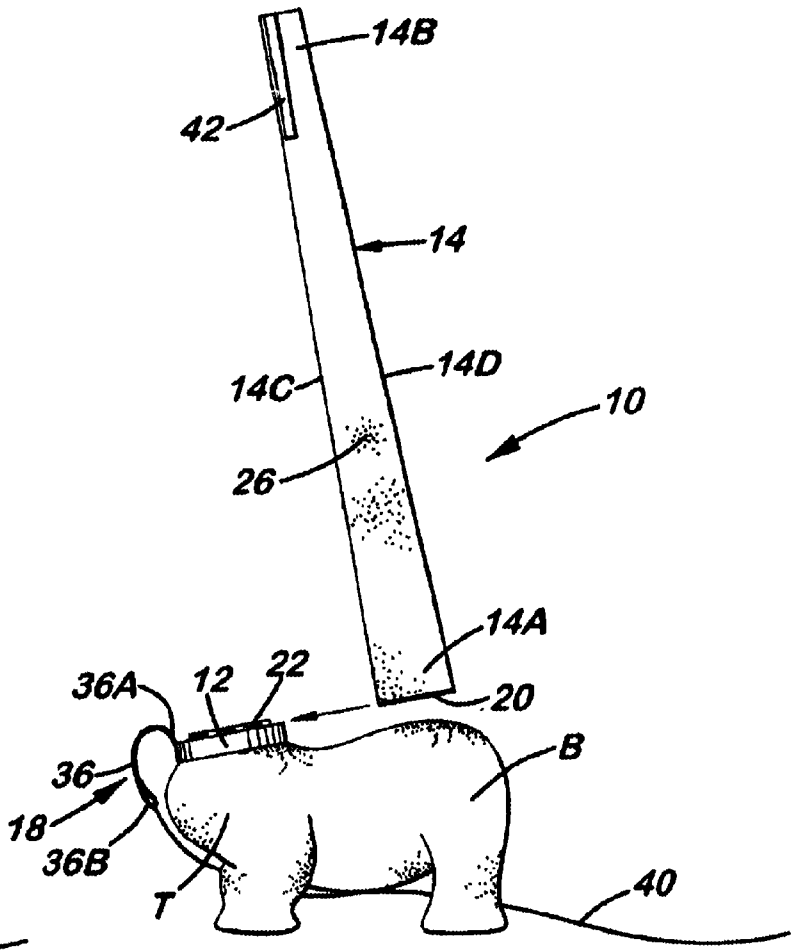
FIG. 4 is a side elevational view of the novelty article similar to that of FIG. 3 but now showing the elongated member removed from the base member of the novelty article.
Figure 3:
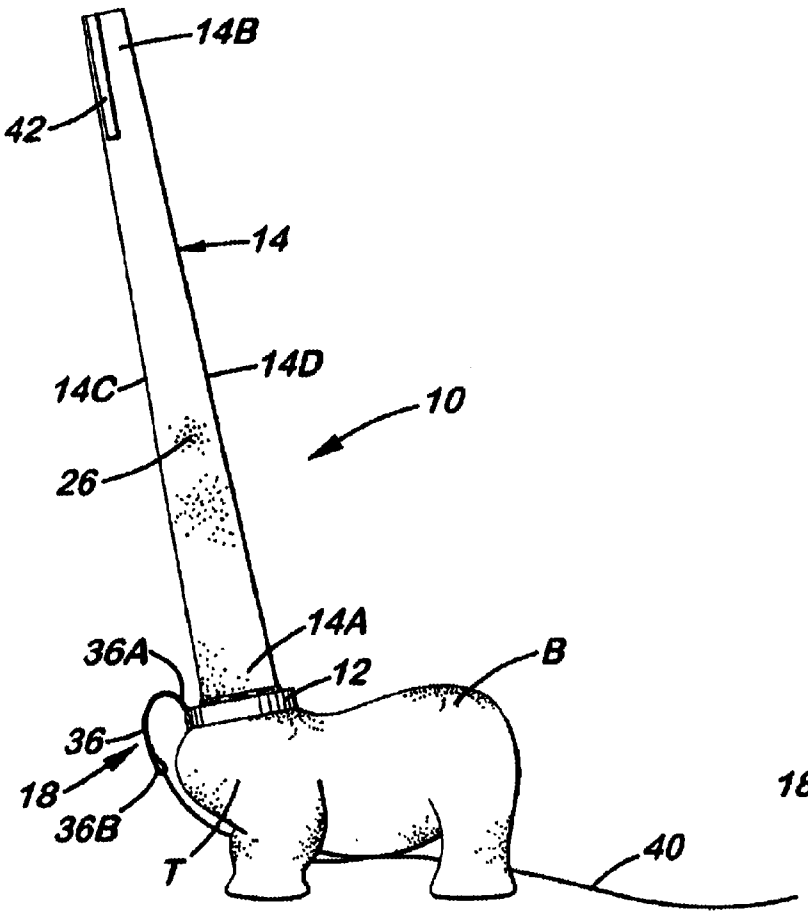
FIG. 3 is a side elevational view of the novelty article as seen along line 3—3 of FIG. 1 showing the elongated member mounted on a base member of the novelty article which is attached on the front shoulders of the body of the plush-type toy.
Figure 8:
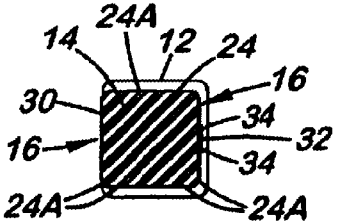
FIG. 8 is an enlarged cross-sectional view of the elongated member and the detachably attachable elements of the novelty article taken along line 8—8 of FIG. 7.
Figure 5:
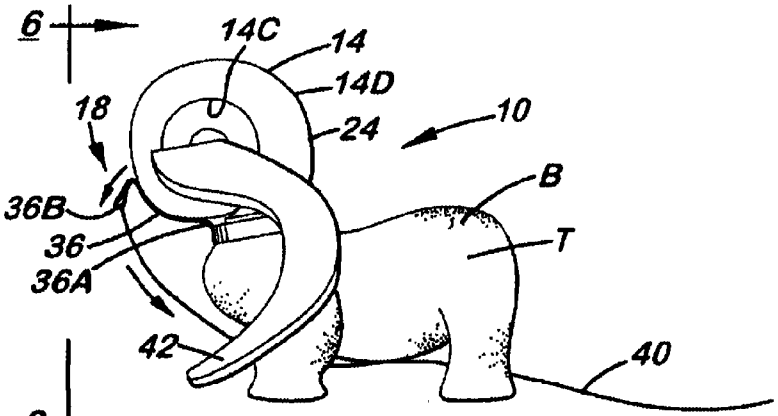
FIG. 5 is a side elevational view of the novelty article similar to that of FIG. 3 but now showing the elongated member disposed in a rolled-up compact condition and the direction in which an attachment element of the novelty article is pulled to cause release of the elongated member from its rolled-up compact condition.
Figure 6:
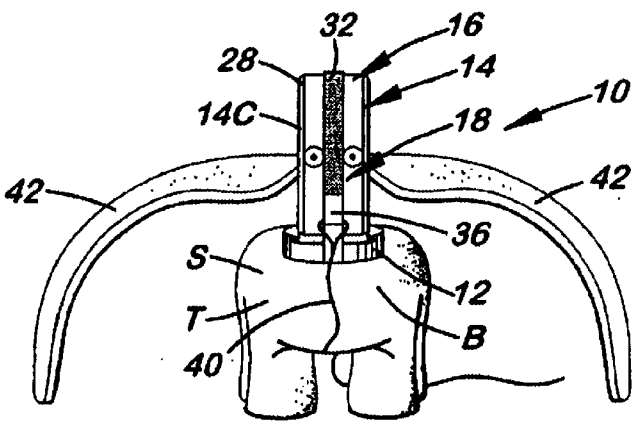
FIG. 6 is a front elevational view of the novelty article as seen along line 6—6 of FIG. 5.

The elongated member 14 of the novelty article 10 is made of a sufficiently resilient flexible material such that the elongated member 14 tends to assume an unrolled extended condition, as seen in FIGS. 1–4, when unrestrained by an outside force, but so as to be manually rollable upon itself to bring opposite the side portions 14C, 14D of the elongated member 14 into contact with one another as it is rolled upon itself to a rolled-up compact condition, as seen in FIGS. 5 and 6. In the unrolled extended condition of the elongated member 14, the opposite lower and upper ends 14A, 14B thereof are spaced remote from one another, whereas in the rolled-up compact condition the opposite lower and upper ends 14A, 14B thereof are spaced adjacent to one another. Preferably, the elongated member 14 includes a strip 24 of flexible spongy material, such as foam rubber, whose natural state is to assume the unrolled straight or extended condition. The strip 24 of flexible spongy material has a generally rectangular cross-sectional configuration, such as seen in FIG. 8, and a plurality of side surfaces 24A which extend lengthwise thereof and are disposed in angularly-displaced relationship to one another. The strip 24 also has a multiplicity of small pores 26 formed therein such that some of the pores 26 are exposed at the side surfaces 24A, as seen in FIGS. 3 and 4.

The elongated member 14 of the novelty article 10 further preferably includes a strip 28 of resiliently flexible paper or plastic sheet material secured on one of the opposite surfaces 24A of the strip 24 of flexible spongy material and extending between the opposite ends 14A, 14B of the elongated member 14. The strip 28 of resiliently flexible sheet material is adapted to assist in supporting the strip 24 of flexible spongy material to assume the unrolled straight or extended condition when unrestrained by the application by any outside force thereto. The strip 28 of resiliently flexible sheet material preferably can take the form of a strip of conventional reinforced tape.

Figure 7:
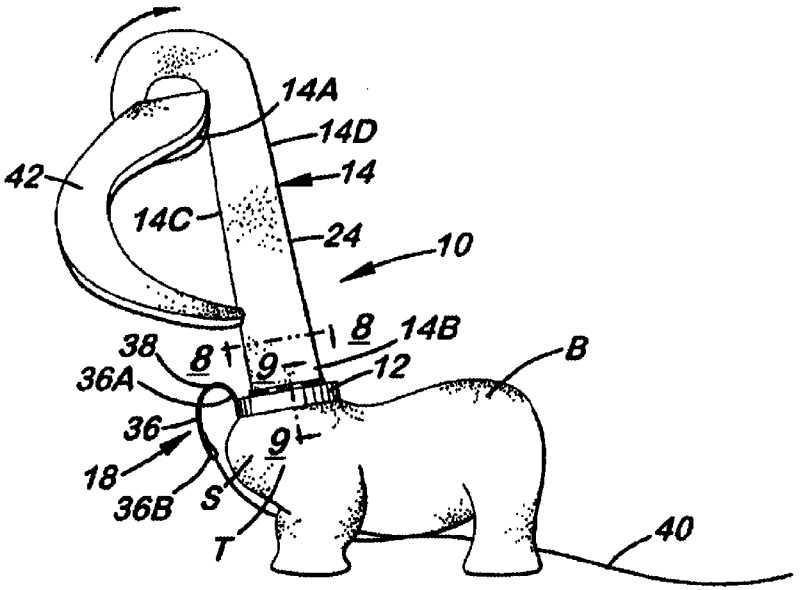
FIG. 7 is a side elevational view of the novelty article showing the elongated member thereof undergoing, the drag-generating controlled unrolling action from the rolled-up compact condition of FIG. 4 to the unrolled extended condition of FIG. 3.

Referring now to FIGS. 1, 2 and 5–8, the detachably attaching means 16 of the novelty article 10 is adapted for detachably attaching together the pair of opposite side portions 14C, 14D of the elongated member 14 when brought into contact with one another. The detaching attaching means 16 is such that upon release of the elongated member 14 from the rolled-up compact condition the detachably attaching means 16 will permit the opposite portions 14A, 14B of the elongated member 14 to detach from one another and the elongated member 14 to return to the unrolled extending condition. However, concurrently, the detachably attaching means 16 generates a drag effect on the detaching of the opposite portions 14A, 14B of the elongated member 14 from one another which limits the elongated member 14 to undergoing a controlled progressive unrolling action that begins at the one of the opposite ends 14A and terminates at the other of the opposite ends 14B of the elongated member 14 as the latter returns to the unrolled extended condition, as shown in FIGS. 5–7. The presence of the detachably attaching means 16 thus ensures that the elongated member 14 unrolls slower than it would in the absence thereof in which case the elongated member 14 would expand to the unrolled extended condition rather than unrolling in the above-described progressive manner.

Preferably, the detachably attaching means 16 includes a strip 30 of flexible mesh material, such as conventional screen cloth, being fixedly secured or adhered on one of opposite portions 14C of the elongated member 14 and extending between the opposite lower and upper ends 14A, 14B thereof, and a first strip 32 of flexible fastening material having hook elements 34 thereon. The first strip 32 of flexible fastening material is narrower than the strip 30 of flexible mesh material and the strip 28 of resiliently flexible sheet material. The first strip 32 of flexible fastening material is secured or adhered on the strip 28 of resiliently flexible sheet material along the centerline thereof such that the hook elements 34 detachably attach to the fine netting or mesh elements 30A of the strip 30 of flexible mesh material upon rolling the elongated member 14 upon itself so as to bring the first strip 32 of flexible fastening material and the strip 30 of flexible mesh material into contact with one another, as seen in FIGS. 5–7.

Referring to FIGS. 1 and 3–7, the latch member 18 of the novelty article 10 is fixedly connected to the base member 12 and detachably secured to the elongated member 14 so as to restrain the elongated member 14 in the rolled-up compact condition, as seen in FIGS. 5 and 6, until the latch member 18 is pulled away and detached from the elongated member 14, as seen in FIG. 7, by a user such that the elongated member 14 is released to undergo the controlled progressive unrolling action from the rolled-up compact condition to the unrolled extended condition. The latch member 18 includes a second strip 36 of flexible fastening material connected at one end 36A to the base member 12 and having loop elements 38 thereon that are attachable to the hook elements 34 of the first strip 32 of flexible fastening material and detachable therefrom upon pulling of the second strip 36 away from the first strip 32. The latch member 18 further includes a pull string 40 attached to a free end 36B of the second strip 36 for use in the pulling thereof.

Figure 10:
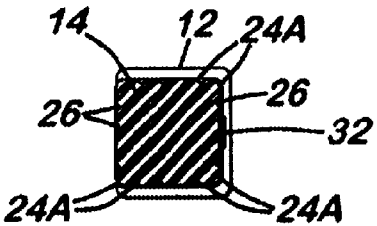
FIG. 10 is an enlarged cross-sectional view of an alternative form of the detachably attachable elements on the elongated member of the novelty article.

Referring to FIG. 10, in an alternative embodiment the detachably attaching means 16 includes the first strip 32 of flexible fastening material having the hook elements 34 thereon. However, now the first strip 32 is secured on the one side portion 14C of the elongated member 14, such being the one of the surfaces 24A of the strip 24 of flexible spongy material, such that the hook elements 34 of the first strip 32 directly detachably attach to the strip 24 of flexible spongy material via the pores 26 in another surface 24A of the strip 24 opposite to the one surface thereof upon rolling the strip 24 of flexible spongy material upon itself so as to bring the first strip 32 of flexible fastening material and the other opposite surface 24A of the strip 24 of flexible spongy material into contact with one another. The first strip 32 of flexible fastening material alteratively can be secured on the strip 28 of resiliently flexible sheet material.

Referring again to FIGS. 1–6, the novelty article 10 may also includes the body B adapted to support the base member 12 and the elongated member 14 mounted on the base member 12 and disposed in the rolled-up compact condition and in an erect self-standing position once the elongated member 14 has begun to undergo the controlled progressive unrolling action toward the unrolled elongated condition. Further, as seen in FIGS. 1–6, the elongated member 14 has one or more appendages 42 attached thereto and extending outwardly therefrom when the elongated member 14 is at both rolled-up compact and unrolled extended conditions. The appendages 42 can take any of a variety of forms, some examples of which are the pair of horns as shown in FIGS. 1 and 2, or a plurality of arms or wings, or strands of hair attached to the elongated member 14. The body B can take any of a variety of suitable forms which will provide balance to the novelty article 10 as the elongated member 14 is unrolled. The base member 12 could be a ring type structure allowing the novelty article 10 to be mounted on a finger of a user.

Figure 12:
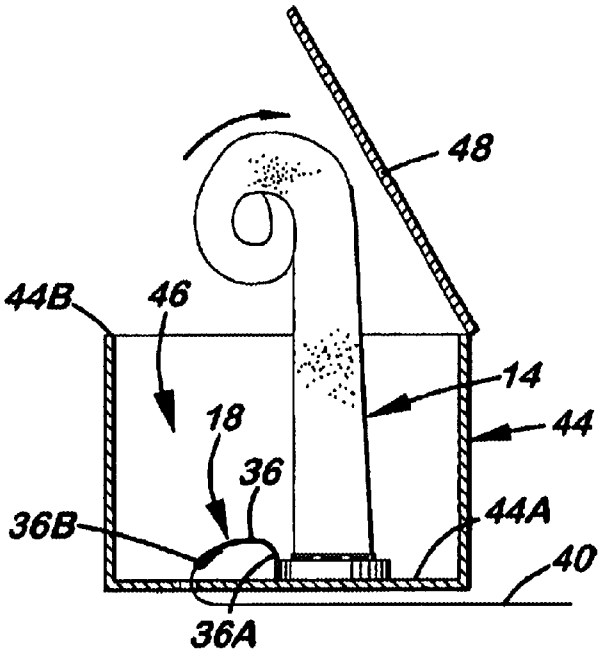
FIG. 12 is a side elevational view of the box shown in an opened condition.
Figure 11:
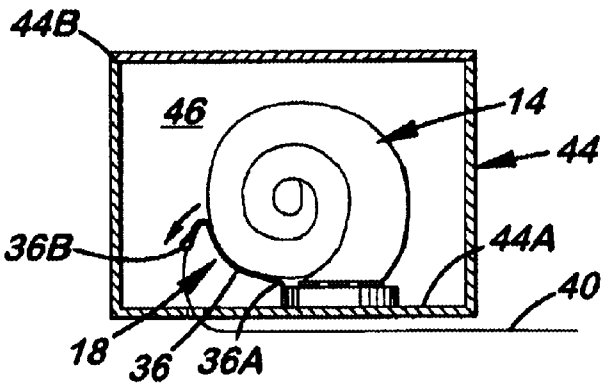
FIG. 11 is a side elevational view of a box for housing the novelty article being shown in a closed condition.

Referring finally to FIGS. 11 and 12, the novelty article 10 also can be provided in conjunction with a box 44 in a manner similar to a Jack-In-The-Box toy. The box 44 has a bottom portion 44A mounting the base member 12, and an interior chamber 46 for storing the elongated member 14 in the rolled-up compact condition as seen in FIG. 11. The box 44 also has an open top 44B and a top cover 48 hinged on a top edge of the box 44 and being movable from a closed position, as seen in FIG. 11, in which the top cover 48 overlying the open top 44B and covers the elongated member 14 in the rolled-up compact condition in the interior chamber 46 of the box 44, to an opened condition, as seen in FIG. 12, in response to the elongated member 14 being released, by pulling on the latch member 18, and unrolling in the controlled progressive manner to the unrolled elongated condition.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A novelty article, comprising:

(a) a base member;

(b) an elongated member made of resiliently flexible material tending to assume an unrolled extended condition when unrestrained by application of any outside force thereto, said elongated member having a pair of opposite ends and opposite portions extending between said opposite ends, said elongated member being mounted at one of said opposite ends to said base member and being manually rollable upon itself so as to bring said opposite portions thereof into contact with one another as said elongated member is rolled upon itself from said unrolled extended condition in which said opposite ends thereof are spaced remote from one another to a rolled-up, compact condition in which said opposite ends thereof are spaced adjacent to one another;

(c) means for detachably attaching together said opposite portions of said elongated member when brought into contact with one another as said elongated member is rolled upon itself to said rolled-up compact condition such that upon release of said elongated member from said rolled-up compact condition said detachably attaching means will permit said opposite portions of said elongated member to detach from one another and said elongated member to return to said unrolled extending condition as said detachably attaching means concurrently generate a drag effect on the detaching of said opposite portions of said elongated member from one another which limits said elongated member to undergoing a controlled progressive unrolling action that begins at said one of said opposite ends and ends at the other of said opposite ends of said elongated member as said elongated member returns to said unrolled extended condition; and (d) an attachment member connected to said base member and detachably secured to said elongated member so as to restrain said elongated member in said rolled-up compact condition until said attachment member is pulled away and detached from said elongated member by a user such that said elongated member is released to undergo said controlled progressive unrolling action from said rolled-up compact condition to said unrolled extended condition.

2. The article of claim 1 wherein said elongated member includes a strip of flexible spongy material whose natural state is to assume said unrolled extended condition, said opposite portions of said elongated member are first and second opposite surfaces of said strip of flexible spongy material extending lengthwise thereof.

3. The article of claim 2 wherein said strip of flexible spongy material is a strip of foam rubber.

4. The article of claim 2 wherein at least one of said first and second opposite surfaces of said strip of flexible spongy material contains a multiplicity of pores therein.

5. The article of claim 4 wherein said detachably attaching means includes a first strip of flexible fastening material having hook elements thereon, said first strip of flexible fastening material being secured on the other of said first and second opposite surfaces of said strip of flexible spongy material such that said hook elements of said first strip of flexible fastening material detachably attach to said strip of flexible spongy material via said pores in said one of said first and second opposite surfaces thereof upon rolling said strip of flexible spongy material upon itself so as to bring said first strip of flexible fastening material and said one of said first and second opposite surfaces of said strip of flexible spongy material into contact with one another.

6. The article of claim 1 wherein said attachment member includes a second strip of flexible fastening material connected to said base member and having loop elements thereon that are attachable to said hook elements of said first strip of flexible fastening material and detachable therefrom upon pulling of said second strip of flexible fastening material away from said first strip of flexible fastening material.

7. The article of claim 6 wherein said attachment member further includes a string attached to said second strip of flexible fastening material for use in said pulling thereof.

8. The article of claim 2 wherein said elongated member further includes a strip of resiliently flexible sheet material secured on one of said first and second opposite surfaces of said strip of flexible spongy material and extending between said opposite ends thereof, said strip of resiliently flexible sheet material being adapted to assist said strip of flexible spongy material in seeking to assume said unrolled extended condition when unrestrained by application by any outside force thereto.

9. The article of claim 7 wherein the other of said first and second opposite surfaces of said strip of flexible spongy material contains a multiplicity of pores therein.

10. The article of claim 9 wherein said detachably attaching means includes a first strip of flexible fastening material having hook elements thereon, said first strip of flexible fastening material being secured on said strip of resiliently flexible sheet material such that said hook elements of said first strip of flexible fastening material detachably attach to said strip of flexible spongy material via said pores in said other of said first and second opposite surfaces thereof upon rolling said strip of flexible spongy material upon itself so as to bring said first strip of flexible fastening material and said other of said first and second opposite surfaces of said strip of flexible spongy material into contact with one another.

11. The article of claim 1 wherein said detachably attaching means includes a strip of flexible mesh material being secured on one of opposite portions of said elongated member and extending between said opposite ends thereof.

12. The article of claim 11 wherein said detachably attaching means includes a first strip of flexible fastening material having hook elements thereon, said first strip of flexible fastening material being secured on the other of said opposite portions of said elongated member such that said hook elements of said first strip of flexible fastening material detachably attach to said strip of flexible mesh material upon rolling said elongated member upon itself so as to bring said first strip of flexible fastening material and said strip of flexible mesh material into contact with one another.

13. The article of claim 12 wherein said attachment member is a second strip of flexible fastening material connected to said base member and having loop elements thereon that are attachable to said hook elements of said first strip of flexible fastening material and detachable therefrom upon pulling of said second strip of flexible fastening material away from said first strip of flexible fastening material on said elongated member.

14. The article of claim 11 wherein said elongated member has a strip of resiliently flexible sheet material secured on the other of said opposite portions thereof and adapted to assist said elongated member in seeking to assume said unrolled elongated condition when not restrained by application by any outside force thereto.

15. The article of claim 14 wherein said detachably attaching means includes a first strip of flexible fastening material having hook elements thereon, said first strip of flexible fastening material being secured on said strip of resiliently flexible sheet material such that said hook elements of said first strip of flexible fastening material detachably attach to said strip of flexible mesh material upon rolling said elongated member upon itself so as to bring said first strip of flexible fastening material and said strip of flexible mesh material into contact with one another.

16. The article of claim 15 wherein said attachment member is a second strip of flexible fastening material connected to said base member and having loop elements thereon that are attachable to said hook elements of said first strip of flexible fastening material and detachable therefrom upon pulling of said second strip of flexible fastening material away from said first strip of flexible fastening material on said elongated member.

17. The article of claim 1 wherein said base member includes a body adapted to support said elongated member in said rolled-up compact condition and in an erect self-standing position once said elongated member has begun to unroll toward said unrolled elongated condition.

18. The article of claim 1 wherein said base member and said one end of said elongated member have respective mateable connector elements thereon which are engageable with one another and disengageable from one another for correspondingly mounting said elongated member on said base member and dismounting said elongated member from said base member.

19. The article of claim 18 wherein said elongated member has at least one appendage attached thereto and extending outwardly therefrom when said elongated member is at both said rolled-up compact condition and unrolled extended condition.

20. The article of claim 1 further comprising:

a box having a portion mounting said base member, an interior chamber for storing said elongated member in said rolled-up compact condition, an open top, and a top cover being movable from a closed position overlying said open top and covering said elongated member in said rolled-up compact condition in said interior chamber of said box to an opened condition in response to said elongated member unrolling to said unrolled elongated condition.

* * * * *